US005431860A

United States Patent [19]

Kozma et al.

[11] Patent Number: 5,431,860

[45] Date of Patent: Jul. 11, 1995

[54] COMPLEX MIXING DEVICE FOR DISPERSION OF GASES IN LIQUID

[75] Inventors: László Kozma; Sándor Kováts, both of Budapest; Béla Mákadi, Debrecen; László Cséke, Debrecen; Sándor Pusztai, Debrecen; Mihály Kaszás, Debrecen; György Sántha, Debrecen; István Barthó, Budapest; Károly Zalai, Budapest; Gyula Beszedics, Budapest; Gabriella Kordik, Budapest; Károly Gergely, Budapest; Miklós Féder, Budapest, all of Hungary

[73] Assignee: Richter Gedeon Vegyeszeti Gyar Rt., Budapest, Hungary

[21] Appl. No.: 234,459

[22] Filed: Apr. 28, 1994

Related U.S. Application Data

[63] Continuation-in-part of Ser. No. 930,515, filed as PCT/HU92/00005, Jan. 31, 1992.

[30] Foreign Application Priority Data

Feb. 1, 1991 [HU] Hungary ..... 364/91

[51] Int. Cl.[6] ..... B01F 3/04

[52] U.S. Cl. ..... 261/93; 261/87

[58] Field of Search ..... 261/87, 93

[56] References Cited

U.S. PATENT DOCUMENTS

| | | | |
|---|---|---|---|
| 134,706 | 1/1873 | Schultze | 261/93 |
| 988,272 | 3/1911 | Lee | 261/93 |
| 1,579,355 | 4/1926 | Greenawalt | 261/87 |
| 2,187,746 | 1/1940 | Lefevre | 261/87 |
| 3,092,678 | 6/1963 | Braun | 261/87 |
| 3,482,520 | 12/1969 | Larsen | 261/87 |
| 3,512,762 | 5/1970 | Umbricht | 261/87 |
| 3,625,834 | 12/1971 | Muller | 261/93 |
| 3,677,528 | 7/1972 | Martin | 261/87 |
| 3,969,446 | 7/1976 | Franklin, Jr. | 261/87 |
| 4,240,905 | 12/1980 | Scaccia | 261/93 |
| 4,594,228 | 6/1986 | Lambert, Jr. et al. | 261/93 |
| 4,699,740 | 10/1987 | Bollenrath | 261/93 |
| 4,896,971 | 1/1990 | Weetman et al. | 261/93 |
| 4,955,586 | 9/1990 | Onizuka et al. | 261/87 |
| 5,073,311 | 12/1991 | Nojima et al. | 261/93 |
| 5,102,630 | 4/1992 | Lee | 261/93 |

FOREIGN PATENT DOCUMENTS

| | | | |
|---|---|---|---|
| 506758 | 11/1951 | Belgium | 261/93 |
| 21470 | 1/1981 | European Pat. Off. . | |
| 1230399 | 12/1966 | France | 261/87 |
| 28-1494 | 2/1953 | Japan . | |
| 53-25272 | 3/1978 | Japan | 261/87 |
| 55-99734 | 7/1980 | Japan . | |
| 56-62535 | 5/1981 | Japan . | |
| 680763 | 8/1979 | U.S.S.R. | 261/87 |
| 738649 | 6/1980 | U.S.S.R. | 261/87 |

OTHER PUBLICATIONS

R. Steel et al; Biotechnology and Bioengineering; vol. IV; "Some Effects of Turbine Size on Novobiocin Fermentations".

*Primary Examiner*—Tim Miles

*Attorney, Agent, or Firm*—Herbert Dubno; Jonathan Myers

[57] ABSTRACT

A mixing device, especially for a fermenter, capable of dispersing gas in a broth therein, in which a number of propeller mixers are provided on a vertically extending shaft. The lower propeller mixer is a gas dispersing mixer having a hollow hub and open channels on the blades extending from this hub and tapering outwardly. At least one intermediate propeller mixer has some blades shorter than others and of reverse flow direction, some blades having baffle bars on trail edges thereof. The upper propeller mixer has the longer blades without channels and flow modifying elements.

6 Claims, 3 Drawing Sheets

$l_2 < l_1$ $\alpha_2 < \alpha_1$ $l_2 < l_1$ $\alpha_2 < \alpha_1$

COMPLEX MIXING DEVICE FOR DISPERSION OF GASES IN LIQUID

CROSS REFERENCE TO RELATED APPLICATION

This application is a continuation-in-part of Ser. No. 07/930,515 filed 25 Sep. 1992 (now U.S. Pat. No. 5,312,567 of 17 May 1994).

Application Ser. No. 07/930,515, in turn, is a national phase application of PCT/HU92/00005 filed 31 Jan. 1992 and based, in turn, on Hungarian national application 364/91 filed 1 Feb. 1991 under the international convention.

FIELD OF THE INVENTION

The present invention relates to a device for dispersion of gases in liquid and for blending the mixture intensely in cylindrical upright bioreactors and in other similar reactors.

BACKGROUND OF THE INVENTION

At present the so-called Rushton turbomixer, rotated by a shaft centrally arranged in the fermenter and consisting of six rectangular straight blades radially fixed to a circular plate is mainly used in bioreactors (fermenters). If the height of the bioreactor is a multiple of the diameter, a system consisting of 2–6 turbomixers fixed to a common shaft is used.

The air to be dispersed is injected below the lower mixer through a perforated loop expansion pipe, nozzles, or a central nozzle (FEJES, G.: Industrial Mixers, FIG. 46 (p. 52) and FIG. 51 (p. 55).

The turbomixers usually occupy $\frac{1}{3}$ of the fermenter diameter and disperse the air efficiently by the intensive turbulence and shear forces generated around the row of blades. However, in consequence to the high local energy dissipation,—despite the high specific power consumption of the turbomixers—the proportion of energy introduced into the zones farther from the mixer is minimal, and the axial transport capacity of the mixer is low, which causes problems especially in the wake of the expanding volume of the bioreactors.

There are also known two-winged or multi-winged propeller mixers with inclined blade or bent according to the geometry of a helical surface, and a mixing system built up from these.

SEM type mixers utilize the flow properties of the thin propeller wings; while EKATO mixers utilize the interference phenomena of the parallel double wing blades arranged at an angle and at the required distance above each other (Interming and Interprop mixers, FEJES, G.: Industrial Mixers FIG. 66, p. 65).

The energy dissipation of propeller mixers with large diameter ratio compared with the diameter of the fermenter ($d/D \geqq 0.5$–$0.2$) is more uniform, and the axial transport capacity is high. Therefore, with the same power consumption, these devices can mix the liquid more efficiently and evenly in large and narrow fermenters, but their dispersion capacity is weaker. That is intended to be counterbalanced with the use of several phases, and with larger agitator diameter than that of the turbomixers.

Suction mixers consisting of hollow mixing elements fixed to a rotating tubular shaft suitable for mixing, dispersion and partly for transport of the gas are also known. The hollow mixing elements are mostly pipes cut at an angle of 45°, at the end of which—at suitable speed—a pressure drop occurs, sucking in the gas usually through the hollow tubular shaft. The gas is atomized by the shear forces generated in the liquid by the sharp pipe-ends (FEJES, G.: Industrial Mixers, p. 57).

These mixers are not used in the fermentation industry because of their limited suction capacity. Suction mixes are also known in which the hollow elements are nearly semi-circulator channels open on the side opposite the direction of displacement, the diameter of which is nearly the same as that of the container, and thus which are suitable for the atomization of relatively large amount of gas (E. Braun: Apparatus for Gasifying Liquids, U.S. Pat. No. 3,092,678). However, because of their low circulation capacity, they are used only in the yeast industry and sometimes in processes not requiring intensive mixing of the liquid.

The purpose of mixing in the reactors is the homogeneous distribution of the solid, liquid and gaseous phases for intensification of the material and heat transfer processes. As a result of mixing, a significant velocity gradient and turbulence are brought about in the space between the mixing elements and the reactor wall provided with buffle plates. In the case of fermentation processes, the velocity-gradient-proportional turbulence and shear forces increase the dispersion of the injected air bubbles, and reduce the thickness of the boundary layers between the microorganisms, culture medium and air bubbles, thereby improving and speeding up the material-transfer and heat transfer processes taking place at the boundary surfaces of the phases.

A three-phase system of the microorganisms, culture medium and injected air is brought about in the bioreactors, where the flow space and its effect on the transfer of material are made extremely complicated by the various interactions, such as change in the rheological properties of the fermenting liquid as a consequence of the metabolism of the microorganisms. The problem is further complicated by diversity and contradiction of the requirements. For example, in a significant number of fermentation processes intensive turbulence and shear are required for dispersion of the air and oil drops, microblending of the culture medium and biomass and cutting up of the agglomerates. At the same time, however, the intensive mixing facilitates the formation of stable foams which partly directly and partly by the foam-inhibiting materials reduces the oxygen transfer and venting of the carbon dioxide, and may mechanically damage the microorganisms, or my bring about production-reducing morphological changes.

It is characteristic to the complexity of the mixing processes taking place in the bioreactors, that each basic operation: dispersion, suspension, dissolution, homogenization, etc. has an important role in the processes. Essentially each fermentation process has its associated specific requirements significantly different according to the type and strain. Thus, the effects of the basic operations should remain within relatively narrow limits in order that—besides the required beneficial effect—the adverse effects should remain minimal. In respect of the turbomixers used in the majority of the bioreactors, it is equally unfavorable to expend the major proportion of the mixing energy for the generation of turbulence. Dissipation of about 70% of the mixing energy takes place in the immediate vicinity of the turbine blades, and these conditions can be changed only in a minor degree.

In the case of fermenting liquids forming intensively aerated viscous and stable foams with non-Newtonian properties, the circulation and turbulence generated by small diameter turbomixers may slow down relatively quickly. The circulation could be intensified with increasing the turbomixer diameter, but this is limited by the disproportionate growth of the mixing power, which—according to the known relationship—increases with the 5th power of the mixer diameter. Therefore, the diameter of the turbomixer must not exceed 40% of the apparatus even in case of small fermenters with capacities below 40 $m^3$. Thus a characteristic feature of such mixers is the small diameter ratio. On the other hand, this causes additional problems, as the reactor volume and viscosity of the fermenting liquid increase. In this case insufficiently mixed zones appear away from the mixers and the mixed zones become prone to compartmentalization (A. W. Nienow: New Agitators v. Ruston Turbines; Int. Biotech. Symposium (9th, 1992. Crystal City, Va.) pp. 193–196).

The diameter of the propeller mixers—with regard to their much lower rate of power input—may approach the diameter of the reactor. Therefore, use of propeller mixers of high diameter ratio making up 50–70% of the apparatus' diameter is becoming widespread in the bioreactors, the dispersion capacity of which is lower but more suitable for the efficient top-to-bottom mixing of the viscous shear-thinning fermenting broths (B. C. Buckland et al: Biotechnology and Bioengineering, Vol. 31. Pages 737–742 1988)

To provide an efficient mixer is difficult because properties of the viscous fermenting liquids containing microorganisms and air bubbles are often extremely different from those of the Newtonian liquids. Some scientists have found that the turbomixer with smaller diameter is capable of yielding an 8-times higher rate of oxygen absorption, than the turbomixers of greater diameter under the same energy input, although such difference cannot be detected in clear water input, although such difference cannot be detected in clear water (Steel, T. -Maxon, W. D.: Biotechn. and Bioeng. 2, 231, 1962). These not well known phenomena dependent on the properties of cultures and composition of the culture media also justify the build-up of mixing systems, the mixing effect of which can be controlled within wide limits and can be modified in respect of every mixing operation.

On the other hand, a common characteristic of the describe mixers is that they are suitable only for producing a single dominant mixing effect e.g. dispersion, homogenization. Furthermore a common disadvantage is manifested in the fact that the hydrodynamic properties of the mixers can be varied by changing their geometry and rotation speed only to a very limited extent, so that the disadvantages originating from their specific modes of action will remain. These disadvantages could limit optimization of the processes.

The efficiency of mixing high viscosity shear thinning broths in respect of the apparatus depends on the magnitude of the introduced energy and construction of the mixing system. The dissolved oxygen concentration can be improved to the required level generally with the known mixers by increasing the amount of mixing energy and the injected air. However, the disproportionately increasing demand for energy and its cost, intensification of the foam formation and impairment of the microorganisms may limit the economic production as the reactor dimensions increase.

The known multi-stage turbine mixers consist usually of elements of the same shape, and other mixing systems do not provide adequate flexibility for satisfying the specific requirements of the various miroorganisms, due to the mentioned capabilities and restrictions of the construction.

As a consequence of the growing dimensions of the bioreactors, the differences in the functional conditions increase and so too increases the differences in the technical facilities of the mixer stages, which are needed for efficient performance.

OBJECTS OF THE INVENTION

The principal object of the present invention is to extend the principles of our earlier application mentioned above.

Another object of the present invention is to provide a complex mixer for dispersion of gases in liquid and for intensive blending of the mixture, wherein the dispersing capability of the mixer exceeds that of the turboagitators and the homogenizing (bulk blending) capability of the propeller agitators, without the disadvantageous properties of the agitators.

Still another object of the invention is to eliminate the power dissipating peaks experienced in the region close to the turboagitators and enable varying the ratio of the energy used for dispersing the air (turbulence) and for mixing the fermentation broth (homogenization, top-to-bottom bulk blending) over an extremely wide range.

Yet another object of the invention is to provide a mixer with a high flooding limit.

SUMMARY OF THE INVENTION

The mixing device according to the invention provides a continuous stirred reactor performance in vertical positioned full baffled bioreactors (fermenters) or in similar devices and comprises:

a vessel provided with a vertically extending driven shaft, a gas dispersing propeller mixer, preferably a lower one, on said shaft, having a hollow hub and blades mounted on said hub, open channels opposite the direction of rotation at least on one of the blades, said channels having an increasing cross section from the tip of the blade to the hub and being in connection with the inside of the hollow hub through holes in the wall of the hub and a gas inlet pipe opening into the inside of the hub;

at least one propeller mixer on said shaft wherein at least a part of the blades is shorter, has smaller angle of the incidence than and is of reverse delivery direction with respect to the blades producing the main flow and baffle bars are mounted on the trailing edges of the blades; and an upper propeller mixer on said shaft provided with blades of the same shape as that of the blades of the lower mixer part, but without channels.

Preferably ancillary wings are mounted above or below the tailing edges of same blades, said wings including an angle of maximum 10° to the main blades. The blades and the wings form flow intensifying slots between them.

The width of the ancillary wings is at least 30% of the width of the blade. The angle between the blades and the wings is a maximum of 20°.

The channels may be arranged directly on the blades or there may be a distance between the blades and channels, this distance being less than twice the width of the channel opening.

There are some blades of shorter length, opposite and of smaller angle of incidence than the other blades of the same mixer, producing the main flow. These blades have, accordingly, a smaller delivery capacity and reverse delivery direction from the other blades.

The mixing device according to the invention enables that energy proportions spent on the generation of circulation and turbulence can be evenly distributed in the whole volume of the gas liquid mixture and the processes in the vessel can be optimized even in extreme cases in accordance with the proportions corresponding to the specific requirements in the microorganisms in the fermentation broth.

It is also possible to reduce the specific mixing energy utilization as a result of the improved hydraulic efficiency and to avoid damage of the microorganism which may cause serious problems in the case of turbo mixers.

BRIEF DESCRIPTION OF THE DRAWING

The above and other objects, features, and advantages will become more readily apparent from the following description, reference being made to the accompanying drawing in which.

SPECIFIC DESCRIPTION

The device according to the invention is provided with vertical drive shaft in a full baffled bioreactor (fermenter) or in a similar cylindrical vessel and mixers of different shapes are mounted to said shaft.

Figure 1:
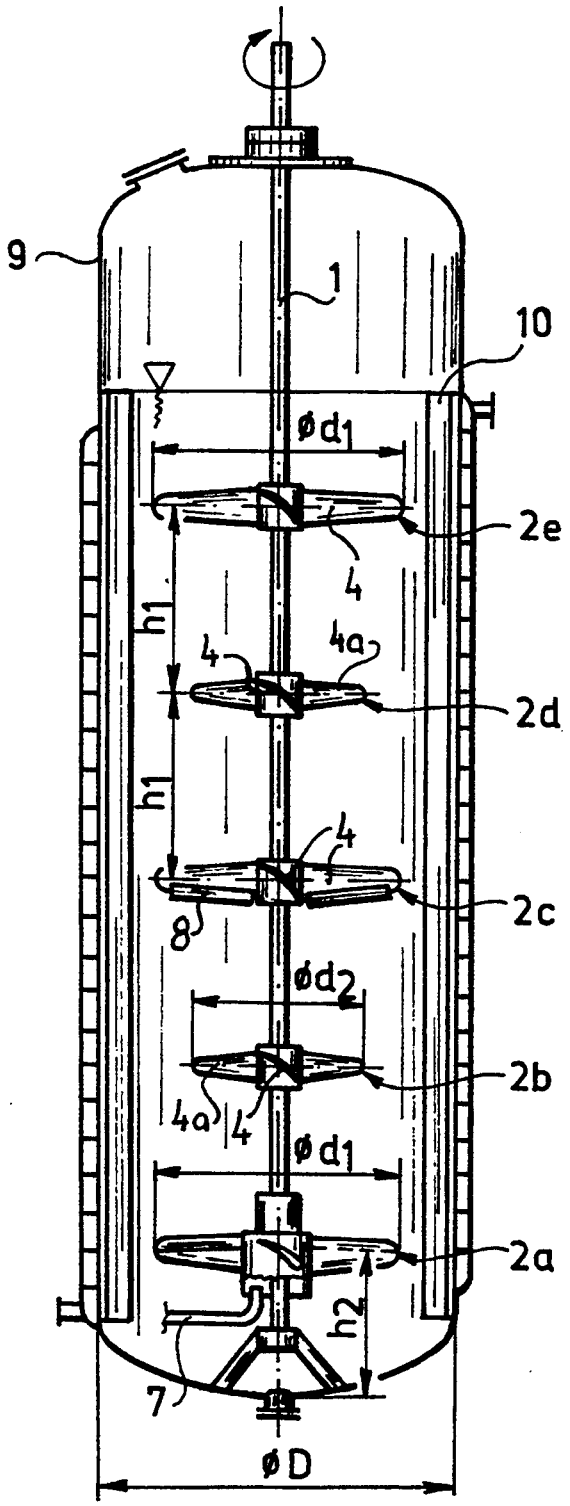
FIG. 1 is a diagrammatic section through the bioreactor according to the invention.

FIG. 1 shows an embodiment of the device according to the invention. Here a mixing shaft 1 is centrally arranged in a bioreactor 9 together with four blade propeller mixers 2*a*–2*e*, and with four relatively narrow vertically disposed internal baffles 10 situated adjacent to the cylindrical reactor wall and extending radially inwardly therefrom.

The gas inlet 7 is arranged at the lower propeller mixer 2*a*. Its diameter $d_1$ is 65% of the bioreactor's diameter D, its transport direction is downwards. Further, three middle propeller mixers 2*b*–2*d* are arranged on the mixing shaft 1. The diameter $d_1$ and direction of transport of propeller mixers 2*c* and 2*e* are the same as those of the dispersing propeller mixer 2*a*, the other two propeller mixers 2*b* and 2*d* have two downward transporting blades 4 with diameter $d_1=0.65$ D and two upward transporting blades 4*a* with diameter $d_2=0.45$ D. The distance $h_1$ between propeller mixers 2*a* and 2*e* is 90% of the diameter of the longer propeller blades 4.

Baffle bars 8 (FIG. 5) are fixed to the blades of the central propeller mixer 2*c*, their width is 3% of the propeller mixer's diameter.

The upper mixer 2*e* is similar to the lower mixer 2*a* but without channels or flow modifying elements.

The above described mixing system is suitable for mixing and aeration of the fermenting liquids of medium viscosity and medium foaming capacity requiring medium mixing intensity. Ancillary blades are not applied here, because these are only useful in the case of fermenting broths of small viscosity.

Figure 2:
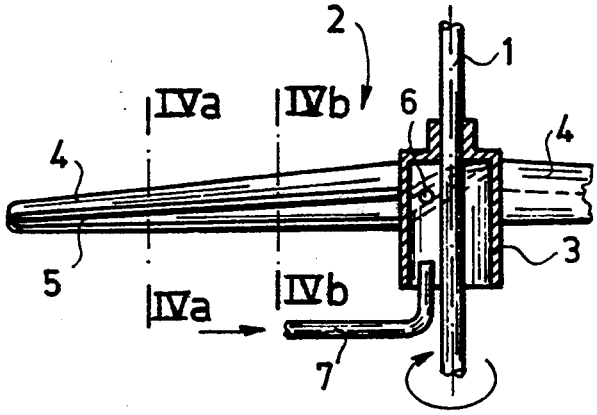
FIG. 2 is a side view of the lower mixer, partly in section.
Figure 4B:
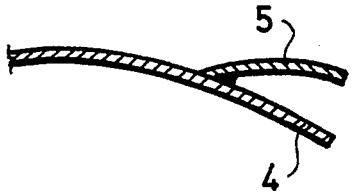
FIG. 4*b* is a section along line IVb—IVb of FIG. 2.
Figure 4A:
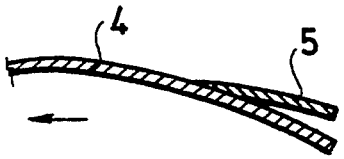
FIG. 4*a* is a section along line IVa—IVa of FIG. 2.
Figure 3:
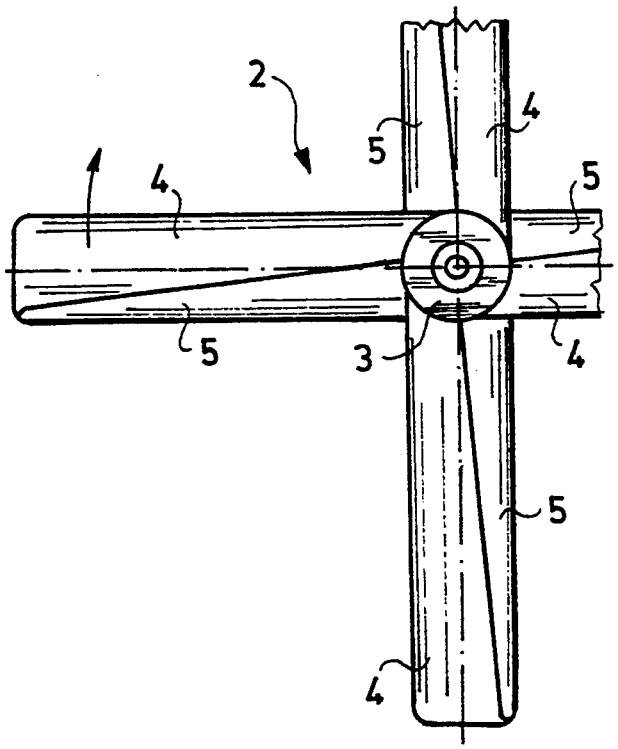
FIG. 3 is a top view of the mixer of FIG. 2.

FIGS. 2 and 3 show a dispersing propeller mixer 2*a* mounted lowermost on the mixing shaft 1 of the reactor 9 shown in FIG. 1. The mixer consists of propeller blades 4 arranged on a hollow hub 3. Air suction-dispersing channels 5 are mounted on the trailing edges of the blades 4. The openings of the channels are opposite the direction of rotation of the mixers and they taper from the hub to the tip of the blades, as is shown in FIGS. 4*a* and 4*b*.

Channel 5 is in communication with the hollow hub 3 through the holes 6. The gas passes through gas inlet 7 into the hollow hub 3 and from there through holes 6 into the channels 5.

The gas can be conducted to the hollow hub in known manner also through the hollow shaft, but this is not customary for the bioreactors.

Figure 6A:
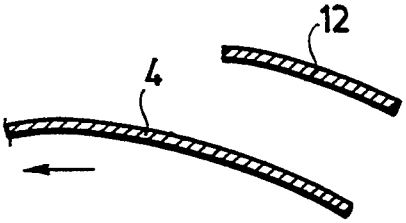
FIG. 6*a* is a section of a blade with ancillary wing.

Channels 5 are generally arranged in the full length along the trailing edges of the blades. They can be arranged (generally with less efficiency) on another part of the blades, even in the vicinity of the blades (as it is shown in FIG. 6*a*).

The gas passing through the hollow mixer hub into the channels on the disperser mixing blades of the mixing system according to the invention is exhausted and finely dispersed along the whole length of the channels and blades by the depression and turbulence arising on the suction side of the wing blades forcing the liquid into intensive axial flow, then the gas is entrained by the flow rate forced to efficient axial flow and accelerated by the propeller blades.

The dispersing capability of the described mixer 2*a* reaches the dispersing capability of the Rushton mixers, but the power number is about 22–28% of them. Thus it requires only about 22–28% of power usage of the Rushton agitator of the same diameter. This significant difference can be used for improving the circulation, also the top-to-bottom bulk blending as well as for lowering the power input. It is worth noting that in terms of bubble distribution the optimum diameter ratio would be $d/D=0.6$ to 0.65, this way the agitation surface can be expanded by 25 to 50%.

Usually the gas to be dispersed is conducted into the bioreactor below the lower mixer with the aid of perforated loop expansion pipe or nozzles. Therefore, in the case of several hundred cubic meter capacity bioreactors, the air is transported under high pressure. A further important recognition relating to the mixing system according to the invention is that the primary mixer performing the primary dispersion can be arranged as a higher stage, whereby not only the compression work can be reduced, but the path of air bubbles can be lengthened which can improve the material transfer. This arrangement is not realizable for the known reasons either in case of turbomixers or suction mixers.

Figure 5:
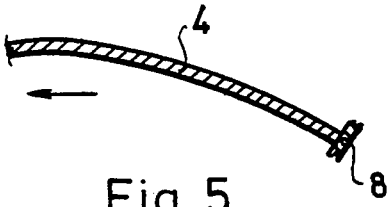
FIG. 5 is a section of a blade with baffle bar.

FIG. 5 shows the cross section of a mixer blade 4 with a baffle bar 8. The baffle bar 8 is mounted on the trailing edge of the mixing blade (as shown in FIG. 1 on the mixer 2*c*). Baffle bars 8 generate the Karman's vortex shedding, the intensity of which is adjustable within wide limits by their width, which however, follow the main flow direction of the mixture, and in this way facilitate the dispersion and mixing of the components without reducing adversely the top-to-bottom blending in the fermenter.

FIG. 6*a* shows the cross section of a mixer blade 4 with ancillary blade 12. Altering the angle of incidence of these auxiliary wings in relation to the main blades, the velocity of the liquid-gas mixture passing between them and between the blade can be altered within wide limits, whereby turbulence of the flow generated by both the primary and secondary mixers can be further intensified.

Figure 6B:
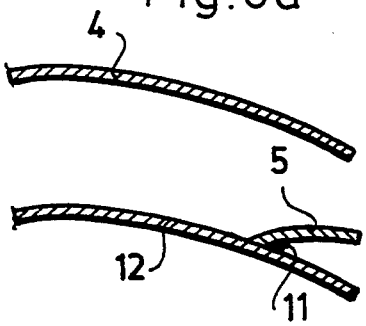
FIG. 6*b* is a section of a blade with ancillary wing provided with a channel.

FIG. 6*b* shows another embodiment of a blade 4 provided with a lower ancillary wing 12, wherein channel 5 is welded 11 to said wing and not to the blade itself.

Figure 7:
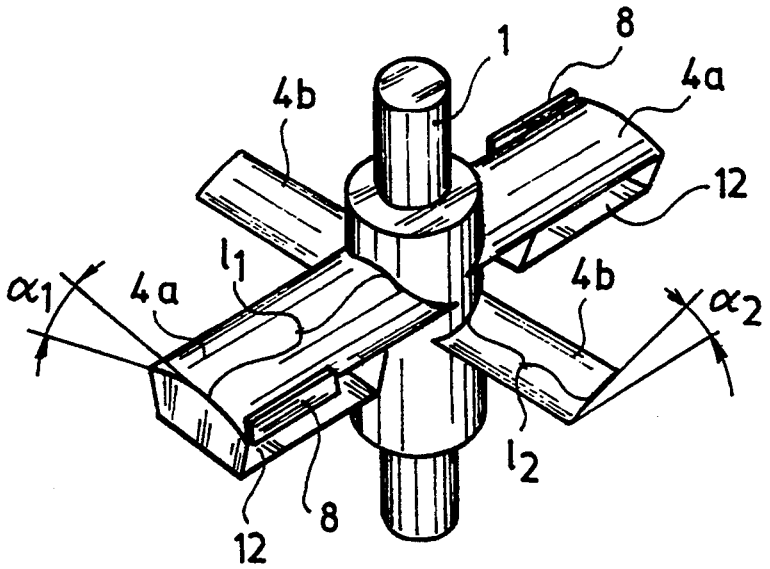
FIG. 7 shows the middle mixer part of the apparatus with all the flow modifying elements.

FIG. 7 shows a mixer in the middle of the shaft 1, provided with flow modifying elements like ancillary wings 12 and baffle bars 8, and reversed blades 4*b*. Two of the four blades of said mixer are in opposite direction and their length 1 and angle of incidence $\alpha$ are less than that of the other blades 4*a*. So they have reverse delivery direction and smaller delivery capacity than the blades producing the main flow. The weaker flow of opposite direction created by the reversed and smaller blades of these propeller mixers performing the intensive circulation of the gas-liquid mixture and the secondary dispersion of each gas bubble, results in a series of vortexes impacting the main top-to-bottom flow, whereby the energy dissipation becomes more uniform, than with a series of vortex generated at the thin blade-ends of the conventionally used turbomixers. The intensity of the so generated vortex series is variable within wide limits by altering the angle of incidence and the length of reversed blades.

Thus, contrary to the restrictions of the traditional turbomixers, the proportion of the amounts of energy spent on circulation and generation of turbulence is variable at will with this specific blade arrangement, and the low dispersing capacity of the traditional propeller mixers can also be improved as necessary.

The dispersion effect of the secondary propeller mixers can also be improved if the propeller wings of smaller angle of incidence and smaller diameter generated weaker counterflow constitute separate stages and are mounted alternatively on the mixing shaft with secondary propeller mixers provided with blade wings of higher transport capacity, thus with greater angle of incidence and greater diameter generating the main flow. With this solution however, fewer impact zones is realizable.

Tests were conducted with the apparatus according to the invention, in the course of which the complex mixing system—in respect of the characteristic hydromechanical parameters, time of homogenization, dispersion capacity and "hold up" of the gas—was found to be more favorable as compared with the traditional Rushton turbomixers.

The measurements took place in clear water and intensively foaming culture medium. Surprisingly, in spite of better dispersion, the rate of foaming was lower than in the case of turbomixers, which is probably the consequence of more uniform energy dissipation.

This is highly significant in respect of the output of the fermentation processes, as the foam-inhibiting materials generally reduce the material transfer.

Based on the described principles, the mixing system an be built up in many ways, and their advantage is just the complexity and variability. However, their efficient operation requires conformance with certain proportions:

Diameter of the mixers with high diameter ratio generating usually downward flow is 50–70% and diameter of the blades with lower transport capacity generating counter-flow is 40–50% of the reactor's diameter. Distance between the mixers is 50–100% of the diameter of the mixers with high diameter ratio. Width of the baffle bars is 3–6% of the mixer diameters.

The intensity of the turbulence produced by ancillary elements depends on the shape and dimensions of said elements. Vortex bends having the smallest intensity may be produced by ancillary wings. These can only be applied in the case of ferment fluids of small viscosity and microorganisms easily damaged. Fermentation broth of middle or high viscosity and microorganisms of high oxygene need are generally mixed with reversed blades, preferably provided with baffle bars.

The combined movement of impellers 2*a*–2*e* in conjunction with the circulations of the inlet air and the fermentation broth results in continuous stirred tank performance, when the rotation of the impellers is effected in an appropriate rate. This is dependent upon the dimensions of the reactor, of the baffles and of the mixing system as well as the densities and rheological properties of the fluids being agitated, and of the quantity of the inlet gas.

The speed of the rotation as well as the measures of the channels, wings and bars can be determined by anyone skilled in the art, on basis of the above data and the experimental measurements usual in the field of biotechnology.

The different versions of the complex apparatus according to the invention allow adaptation of the mixing systems to the extremely different proportions and requirements of the various cultures of microorganisms.

Thus, for example in the case of intensively foaming fermenting liquids—which inhibits the transfer of $O_2$ and the material—the use of a system consisting of a primary mixer with suction channel and secondary propeller mixers without wings and blades of opposite direction can be more favorable. On the other hand, in case of less foaming fermenting liquids of low viscosity, requiring little mixing, the use of a system consisting only of secondary mixers would be sufficient.

In the majority of the known fermentation processes however, a complex system consisting only of primary and secondary mixers ensures the optimal conditions for the transfer of material.

With the complex mixing systems according to the invention every basic mixing operation determining the material transfer, such as energy proportions spent on the generation of circulation and turbulence can be evenly distributed in the whole volume of the mixed gas-liquid mixture and the given processes can be optimized even in extreme cases according to the proportions corresponding to the specific requirements.

The complex mixer according to the invention—depending on the circumstances—as a result of the improved hydraulic efficiency can speed up the intensity of the process in the case of chemical processes, thereby increasing the capacity, incidentally also reducing the quantity of a component taking part in the process, and furthermore improving the yield and to reduce the specific mixing energy utilization in case of the biological processes.

We claim:

1. A complex mixing device for dispersion of gases in liquid and for intensive mixing in vertical full baffled bioreactors and fermenters, said device comprising:

a vessel provided with a vertically extending driven shaft, a gas dispersing propeller mixer on said shaft, having a hollow hub and blades mounted on said hub, open channels opposite the direction of rotation, said channels having an increasing cross section from a tip of the blade to the hub and being in connection with an inside of the hollow hub through holes in a wall of the hub and a gas inlet pipe opening into the inside of the hub;

at least one propeller mixer on said shaft wherein at lest some of the blades are shorter, have smaller angle of the incidence than and are of reverse delivery direction with respect to others of the blades producing main flow and provided with baffle bars mounted on the trailing edges; and an upper propeller mixer on said shaft provided with blades of the same shape as that of the blades of the other mixers without channels and flow modifying elements.

2. The mixing device according to claim 1 wherein the gas dispersing propeller mixer is the lowest mixer in the vessel.

3. A mixing device according to claim 1 wherein the channels are directly on the blades.

4. A mixing device according to clam 1 wherein the channels are above or below the blades and the distance between the blade and channels is less than twice the width of the channel opening.

5. The mixing deice according to claim 1 wherein at least some of the blades are provided with ancillary wings above or below their trailing edges, the blades and the wings forming flow intensifying slots between them.

6. The mixing device according to claim 5 wherein a width of the ancillary wings is at least 30% of the width of the blades and the angle between the blades and the wings is maximum 20°.

* * * * *